US010464642B2

(12) United States Patent
Peterson et al.

(10) Patent No.: US 10,464,642 B2
(45) **Date of Patent: *Nov. 5, 2019**

(54) AUTOMATED BOAT LIFT AND TROLLEY

(71) Applicants: Ronald E. Peterson, Marco Island, FL (US); Arnold E. Peterson, Somis, CA (US)

(72) Inventors: Ronald E. Peterson, Marco Island, FL (US); Arnold E. Peterson, Somis, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/962,193

(22) Filed: Apr. 25, 2018

(65) Prior Publication Data

US 2019/0023365 A1 Jan. 24, 2019

Related U.S. Application Data

(63) Continuation of application No. 15/060,328, filed on Mar. 3, 2016, now Pat. No. 9,957,025.

(60) Provisional application No. 62/128,316, filed on Mar. 4, 2015.

(51) Int. Cl.

| | |
|---|---|
| ***B63C 3/08*** | (2006.01) |
| ***B63C 3/12*** | (2006.01) |
| ***B63C 3/06*** | (2006.01) |
| ***B63C 3/02*** | (2006.01) |
| *E02C 5/00* | (2006.01) |

(52) U.S. Cl.

CPC ..... *B63C 3/08* (2013.01); *B63C 3/02* (2013.01); *B63C 3/06* (2013.01); *B63C 3/12* (2013.01); *E02C 5/00* (2013.01)

(58) Field of Classification Search

USPC ..... 405/1–3

See application file for complete search history.

(56) References Cited

U.S. PATENT DOCUMENTS

| | | | | |
|---|---|---|---|---|
| 4,797,055 | A | 1/1989 | Tworoger | |
| 5,234,285 | A | 8/1993 | Cameron | |
| 6,457,904 | B2 | 10/2002 | Bishop | |
| 6,823,809 | B2 | 11/2004 | Hey | |
| 9,957,025 | B2 * | 5/2018 | Peterson | B63C 3/08 |
| 2002/0176767 | A1 | 11/2002 | Gisselberg | |
| 2009/0010742 | A1 | 1/2009 | Stolzer | |
| 2009/0142135 | A1 | 6/2009 | Bishop | |

* cited by examiner

*Primary Examiner* — Sean D Andrish

(74) *Attorney, Agent, or Firm* — Knobbe, Martens, Olson & Bear LLP

(57) ABSTRACT

An automated system is provided for moving a boat from a storage position in a boat garage to a deployed position in a dock channel. The system can include a boat trolley. The boat trolley can include a bottom frame that couples to and rides on rails of a track that extends between the boat garage and the dock channel. The boat trolley can also include an upper frame that with bunker supports for supporting the hull of the boat. The upper frame can be lifted off of the lower frame by a dock lift mechanism to thereafter lower the upper frame into the water, from which the boat can be deployed. Once done using the boat, the user can navigate the boat onto the upper frame, and the dock lift mechanism used to lift the upper frame and boat out of the water, the upper frame then dropped onto and coupled to the lower frame, and the boat trolley operated to move the boat from the dock to the boat garage for storage.

20 Claims, 20 Drawing Sheets

AUTOMATED BOAT LIFT AND TROLLEY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present invention is directed to a boat lift and trolley assembly, and more particularly to an automated boat lift and trolley assembly with integrated electronic control and sensor system for moving a boat between a boat garage and a dock channel.

Description of the Related Art

Boat lift assemblies exist. However, there is a need for an automated system and method for moving a boat between a boat garage for storage and a dock channel.

SUMMARY

In accordance with one aspect, an automated system is provided for moving a boat from a storage position in a boat garage to a deployed position in a dock channel.

In accordance with another aspect, a method for automated movement of a boat lift and trolley is provided for movement of a boat between a storage position in a boat garage to a deployed position in a dock channel.

In accordance with another aspect, an automated boat lift and trolley system for moving a boat from a boat garage and a dock is provided. The system comprises a track comprising a pair of rails, the track configured to run from a proximal end within a boat garage and a distal end at a dock, the pair of rails disposed beside a dock channel on the dock. The system also comprises a boat trolley configured to support a boat thereon, the boat trolley having a set of wheels that movably couple the trolley to the pair of rails of the track. The system also comprises a lift assembly disposed at the dock, the lift assembly operable to lift the boat off the trolley, and to lower the boat into water through the boat channel. The system also comprises one or more sensors configured to sense one or both of a position of at least a portion of the boat trolley and an operation position of the lift assembly. The system also comprises a controller configured to control operation of the boat trolley to move along the track, and to control the lift assembly to lower the boat into the water based at least in part on the sensed information communicated by the one or more sensors to the controller.

In accordance with another aspect, an automated boat trolley system for moving a boat from a boat garage and a dock is provided. The system comprises a lower frame having a set of wheels configured to movably couple the lower frame a track. The system also comprises an upper frame comprising at least two support bunkers configured to contact and support a hull of the boat thereon, the upper frame having one or more support beams removably coupleable to the lower frame and configured to be lifted off of the lower frame by a lift assembly at a dock. The lower frame comprises one or more delrin guides configured to receive the support beams of the upper frame therein, the delrin guides tapering outward to facilitate coupling of the upper frame to the lower frame, the outward taper configured to guide the beams of the upper frame into alignment with support beams of the lower frame.

DETAILED DESCRIPTION

Figure 1:
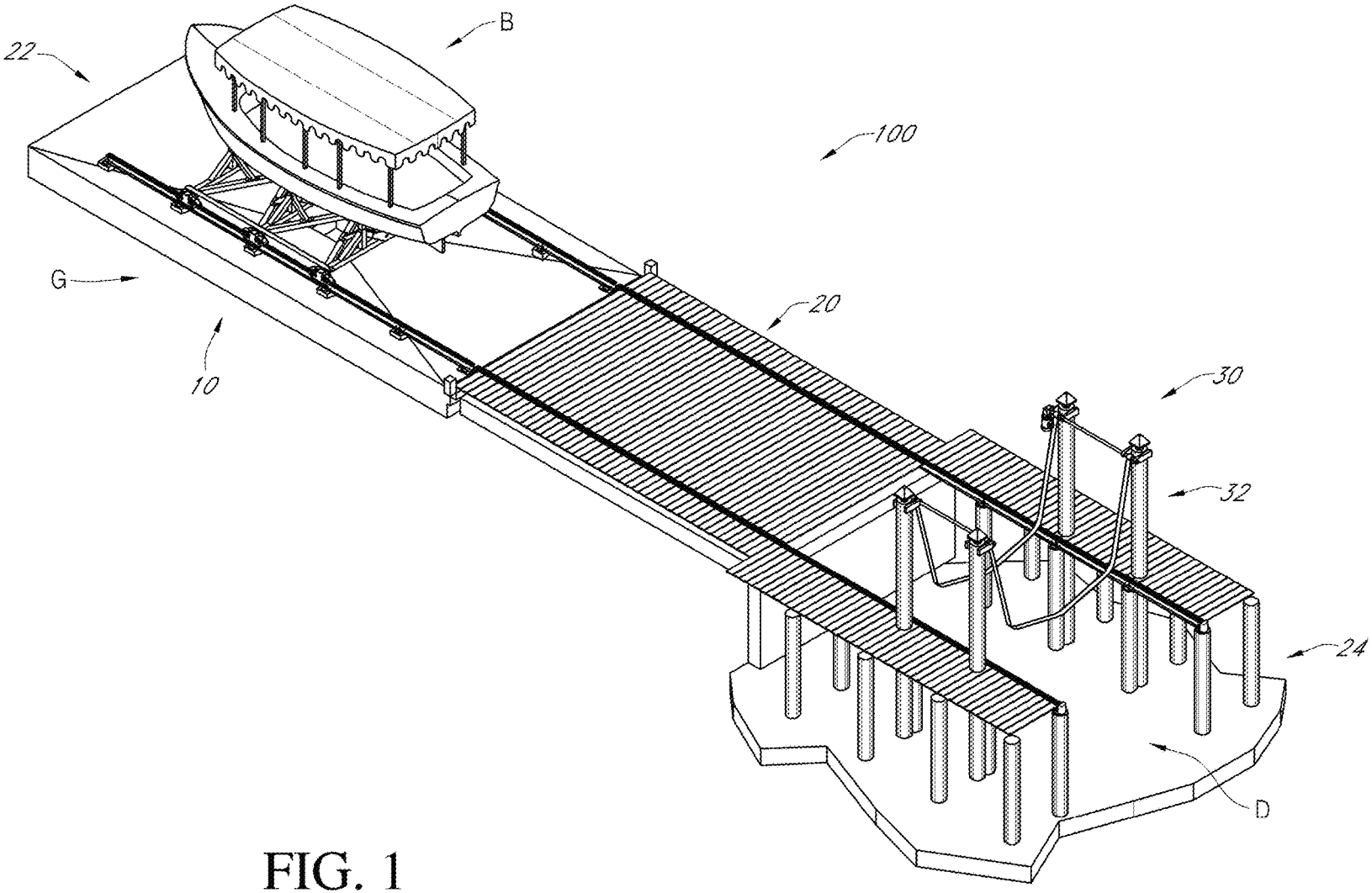
FIG. 1 is a perspective view of an embodiment of an automated boat lift and trolley assembly.

FIGS. 1-5 show an embodiment of a boat lift and trolley assembly 100 (hereafter "the assembly"). The system 100 includes a trolley 10 having a plurality of wheels and a frame on which a boat B can be removably supported. In one embodiment, the trolley 10 frame can be welded and made of aluminum, though other suitable metals or other suitable materials can be used. The trolley 10 frame can have a plurality of adjustable support pads 16 (see FIG. 9) to support a variety of different boat B hull profiles.

The trolley can travel along a track 20 that extends between a first end 22 and a second end 24 so that the track 20 extends between a boat garage G and a dock channel D. The track 20 can have a width W1. The dock channel D can have an opening with a width W2 that is at least as wide as width W1. The boat garage G can have a length L1 that is longer than a length of the boat B. The dock channel D can have a length L2 that is at least as long as the boat B. A height H of the track 20 from a top of the sea wall can be between about 4 inches and about 12 inches, for example about 6 inches. In one embodiment, the length L1 can be between about 30 feet and about 60 feet, for example about 40 feet and the length L2 can be between about 20 feet and about 50 feet, for example about 25 feet. The width W1 can be between about 15 feet and about 30 feet, for example about 19 feet. However, other suitable dimensions for the length L1, length L2 and width W1 can be used.

In the illustrated embodiment, the track 20 extends linearly between the first end 22 and the second end 24. The trolley 10 can travel along a length L3 from the boat garage G to the dock channel D. In another embodiment, at least a portion of the track 20 can have a curved portion (e.g., where needed to accommodate the spatial relationship between the boat garage G and the dock channel D).

A sling assembly 30 can include a plurality of posts 32. In the illustrated embodiment, two pairs of posts 32 are on opposites sides of the opening of the dock channel D. However, the sling assembly 30 can include additional pairs of posts 32. The sling assembly 30 can include a sling that extends between each pair of posts 32 and across the opening of the dock channel D.

Figure 2:
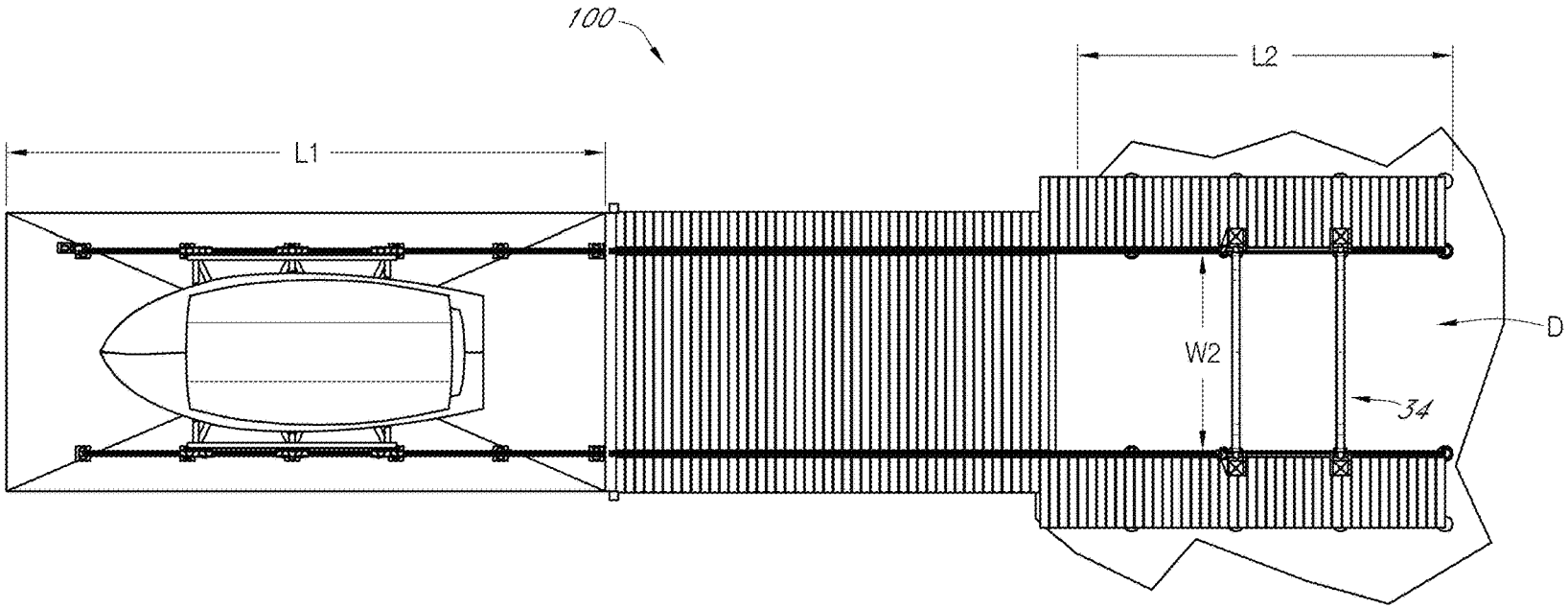
FIG. 2 is a top view of the boat lift and trolley assembly of FIG. 1.
Figure 2A:
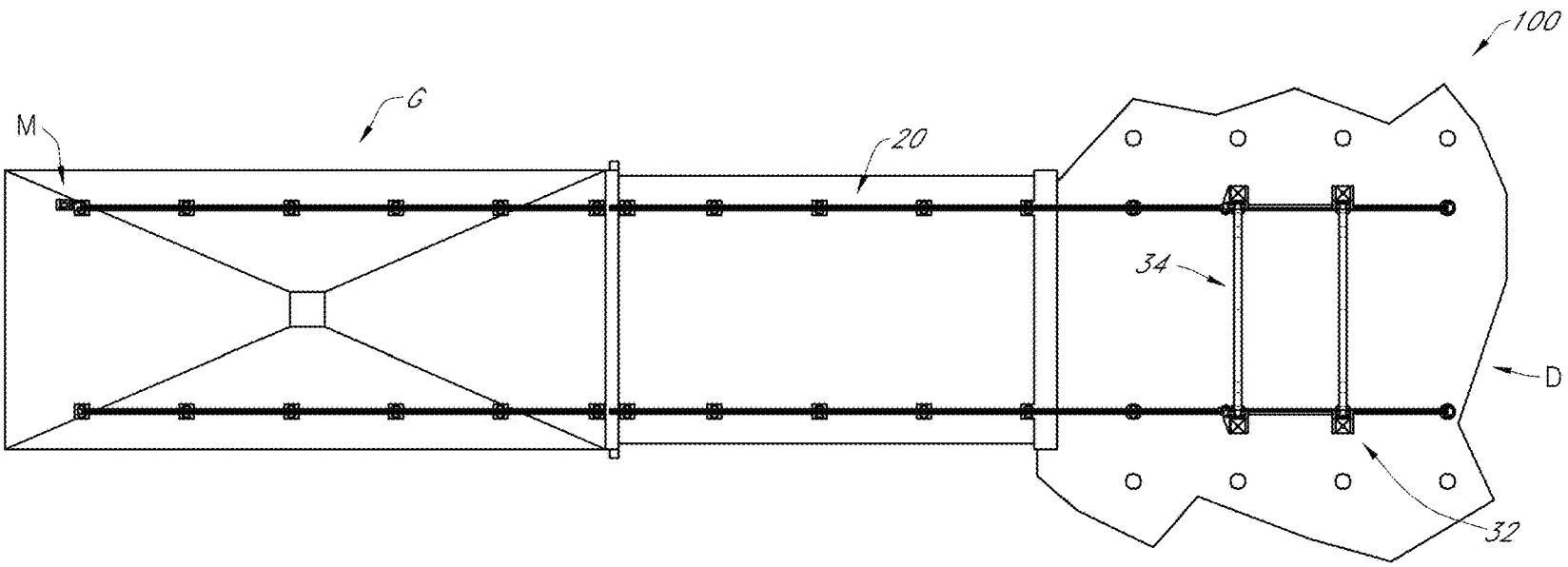
FIG. 2A is another top view of the boat lift and trolley assembly of FIG. 1, without the boat.

The system 100 further comprises a drive assembly, including a motor M see FIG. 2A) (e.g., electric motor, such as a single point robust motor drive) that drives movement of the trolley 10 along the track 20 between the proximal end 22 and the distal end 24. In one embodiment, the motor M can operate a chain drive, such as a stainless steel chain drive, that is attached to the trolley 10 (e.g., to one or more wheels of the trolley 10). In one embodiment, the track drive can be located in the boat garage G.

Figure 2B:
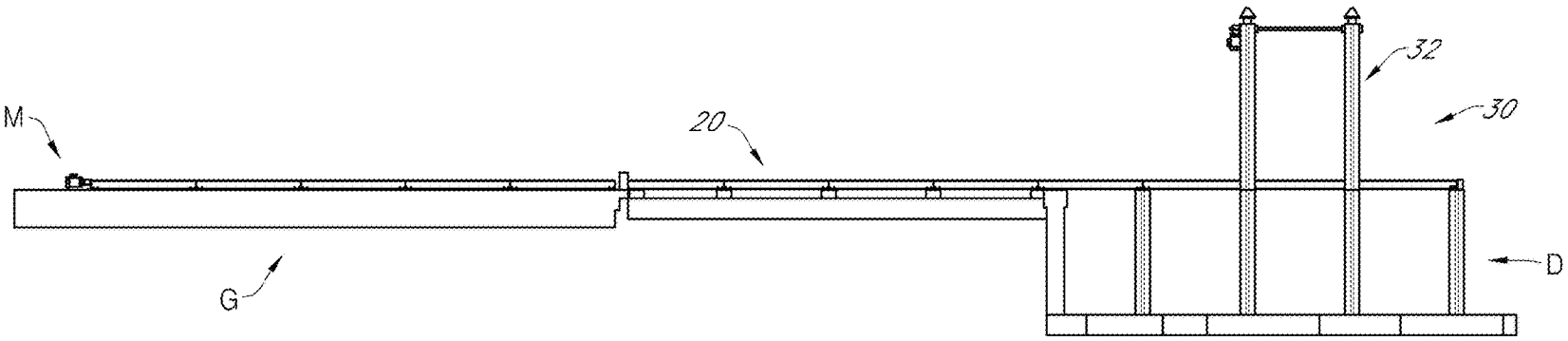
FIG. 2B is a side view of the boat lift and trolley assembly of FIG. 2A.
Figure 3:
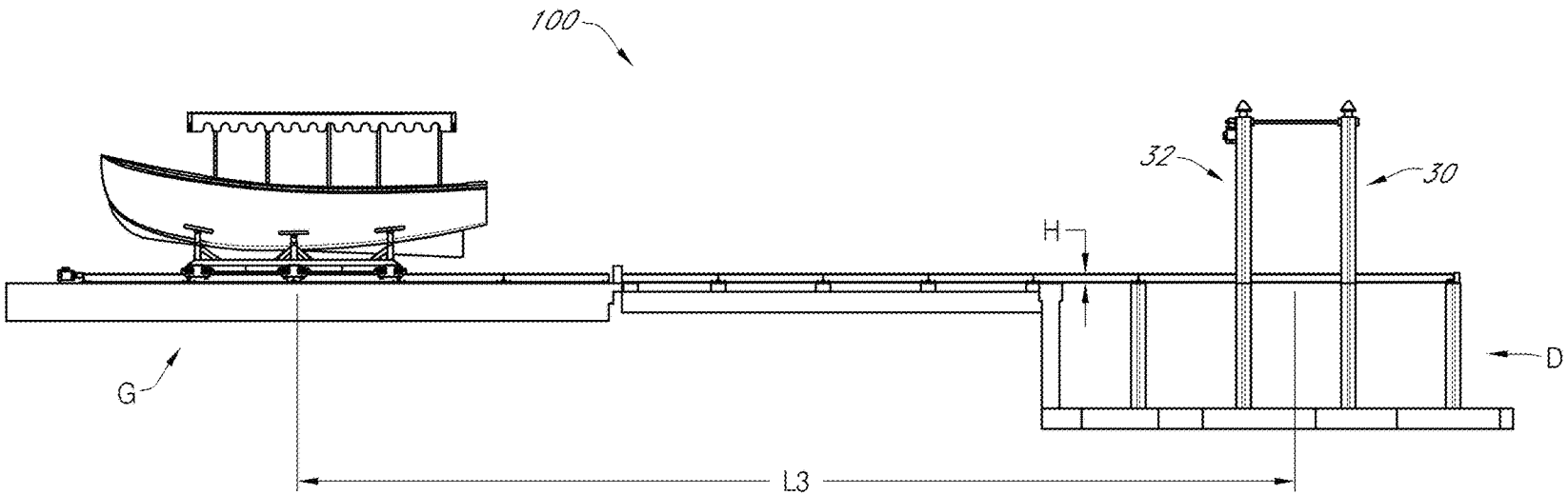
FIG. 3 is a side view of boat lift and trolley assembly of FIG. 1.
Figure 4A:
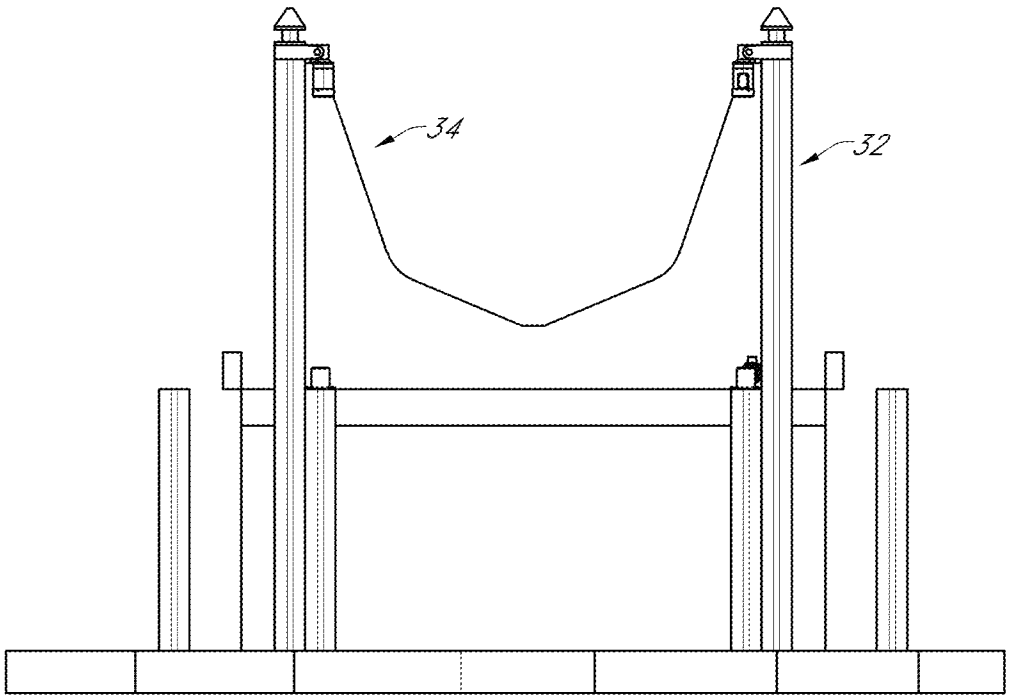
FIG. 4A is a front view of the boat lift and trolley assembly of FIG. 2A, without the boat.
Figure 4B:
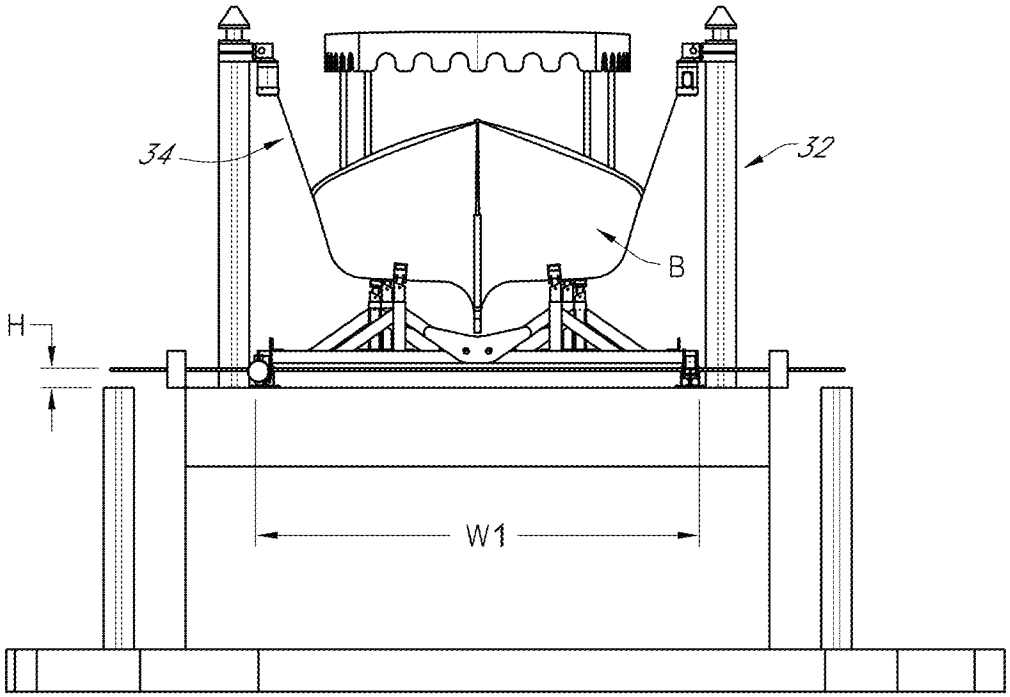
FIG. 4B is a front view of the boat lift and trolley assembly of FIG. 1.
Figure 5:
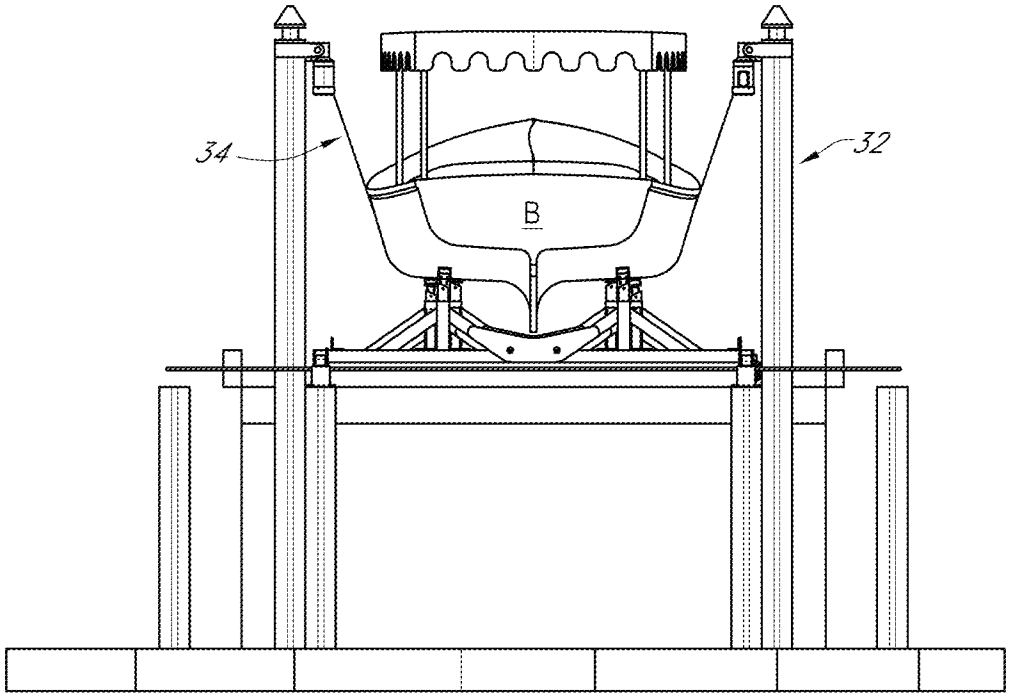
FIG. 5 is a rear view of the boat lift and trolley assembly of FIG. 1.

Though FIGS. 2A-2B and 4A show various dimensions for various components of the assembly 100, one of skill in the art will recognize that the various components of the assembly 100 can have other suitable dimensions.

Figure 6:
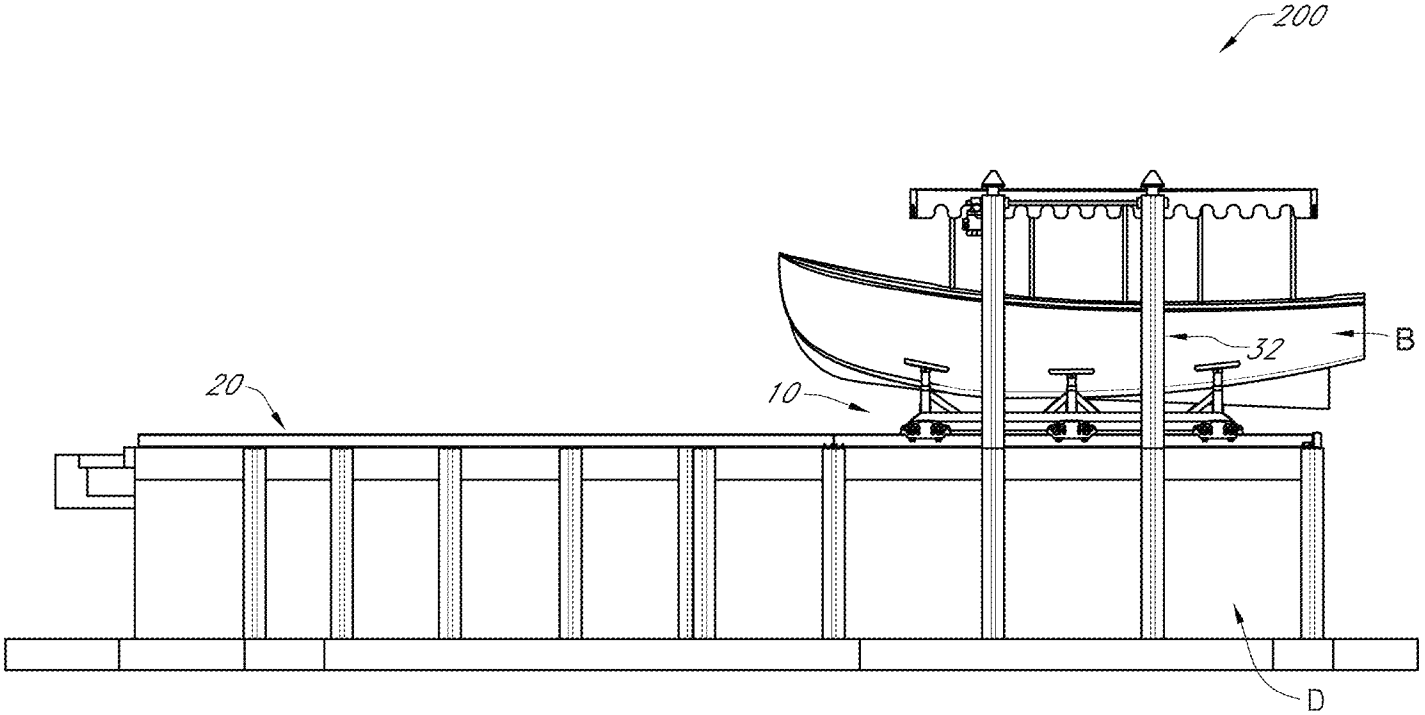
FIG. 6 is a side view of a boat lift and trolley assembly.
Figure 7:
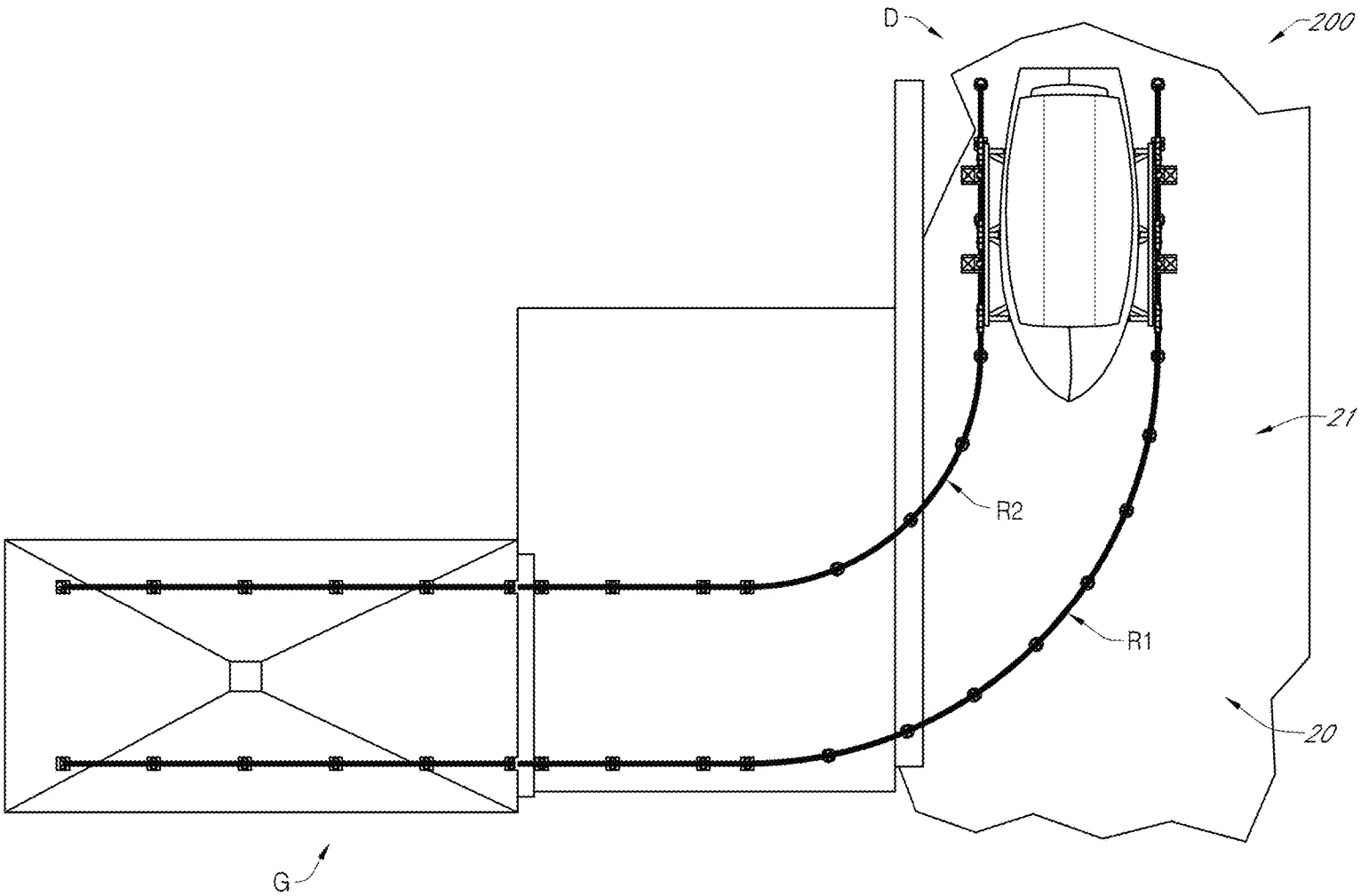
FIG. 7 is a top view of the boat lift and trolley assembly of FIG. 6.
Figure 8:
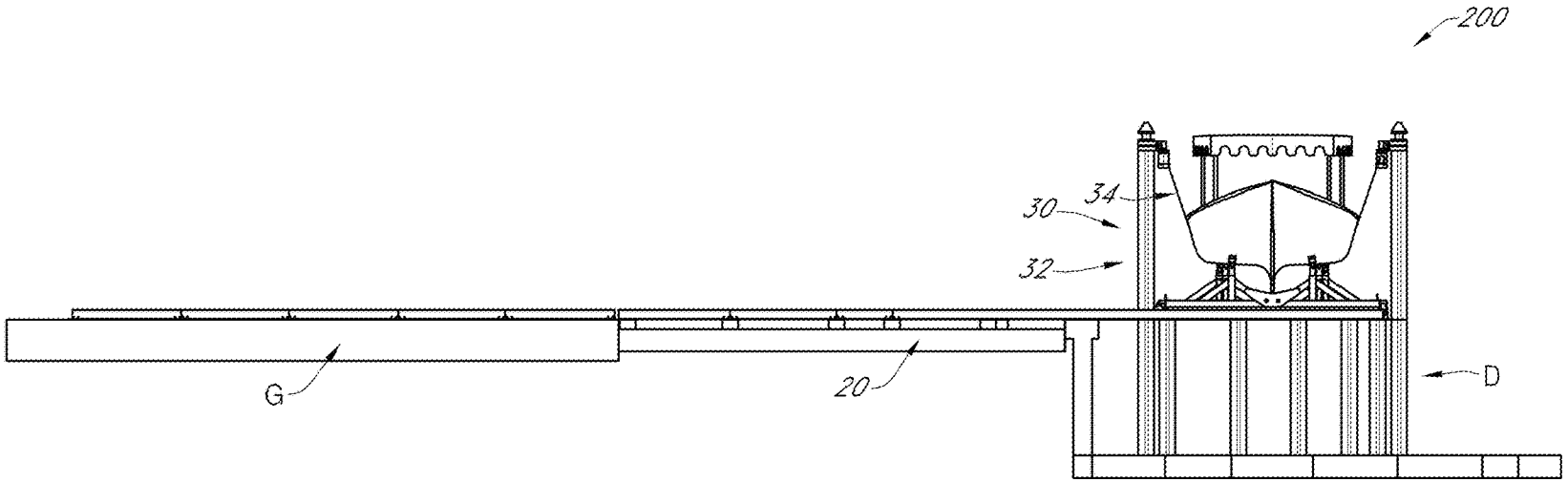
FIG. 8 is a front view of the boat lift and trolley assembly of FIG. 6.

FIGS. 6-8 show another embodiment of a boat lift and trolley assembly 200 (hereinafter "the assembly"). The assembly 200 is similar to the assembly 100 shown in FIGS. 1-5, except as noted below. Thus, the reference numerals used to designate the various components of the assembly 200 are identical to those used for identifying the corresponding components of the assembly 100 in FIGS. 1-5 and the description for the various components of the assembly 100 shown in FIGS. 1-5 is understood to apply to the corresponding components of the assembly 200 in FIGS. 6-8, except as described below.

The assembly 200 differs from the assembly 100 only in that at least a portion of the track 20 has a curved portion 21 between the dock channel D and the boat garage G. As best shown in FIG. 7, the curved portion 21 can have an outer rail with a first radius of curvature R1 and an inner rail with a second radius of curvature R2. In some embodiments, radius of curvature R2 can be less that the radius of curvature R1. Though FIGS. 7-8 show various dimensions for various components of the assembly 200, one of skill in the art will recognize that the various components of the assembly 200 can have other suitable dimensions.

Figure 9:
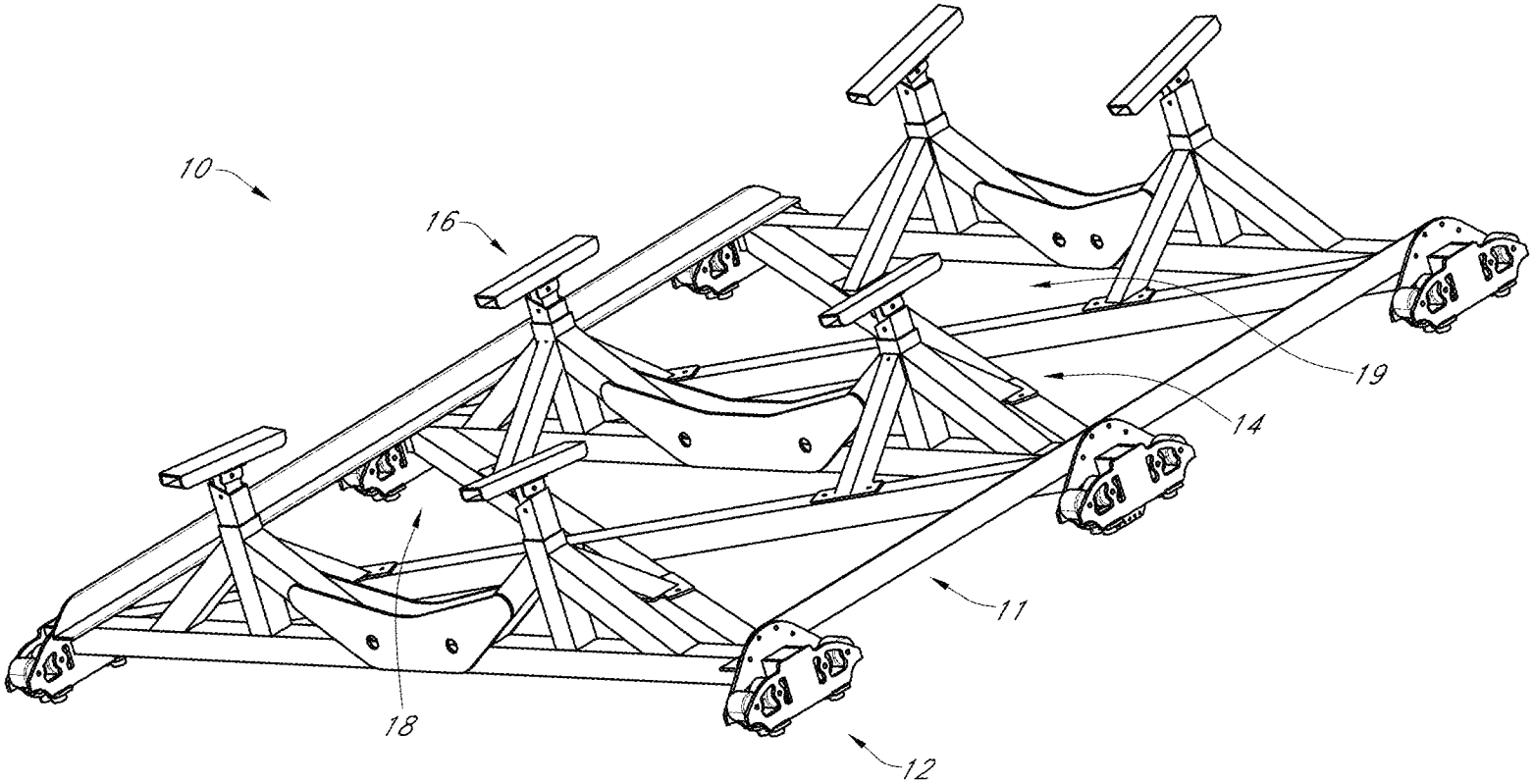
FIG. 9 is a perspective top view of a trolley assembly.
Figure 10:
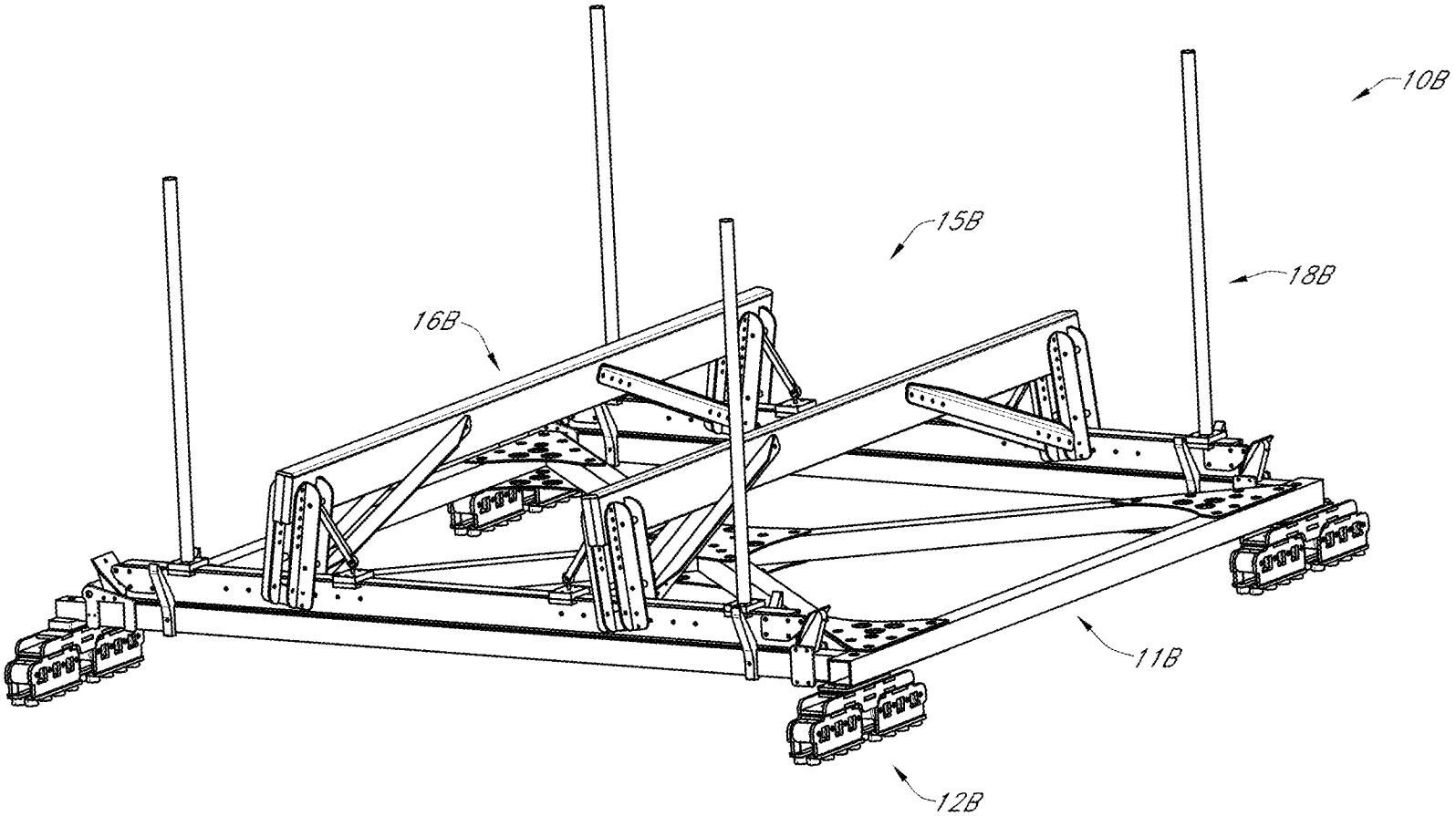
FIG. 10 is a perspective view of another embodiment of a trolley assembly.
Figure 11:
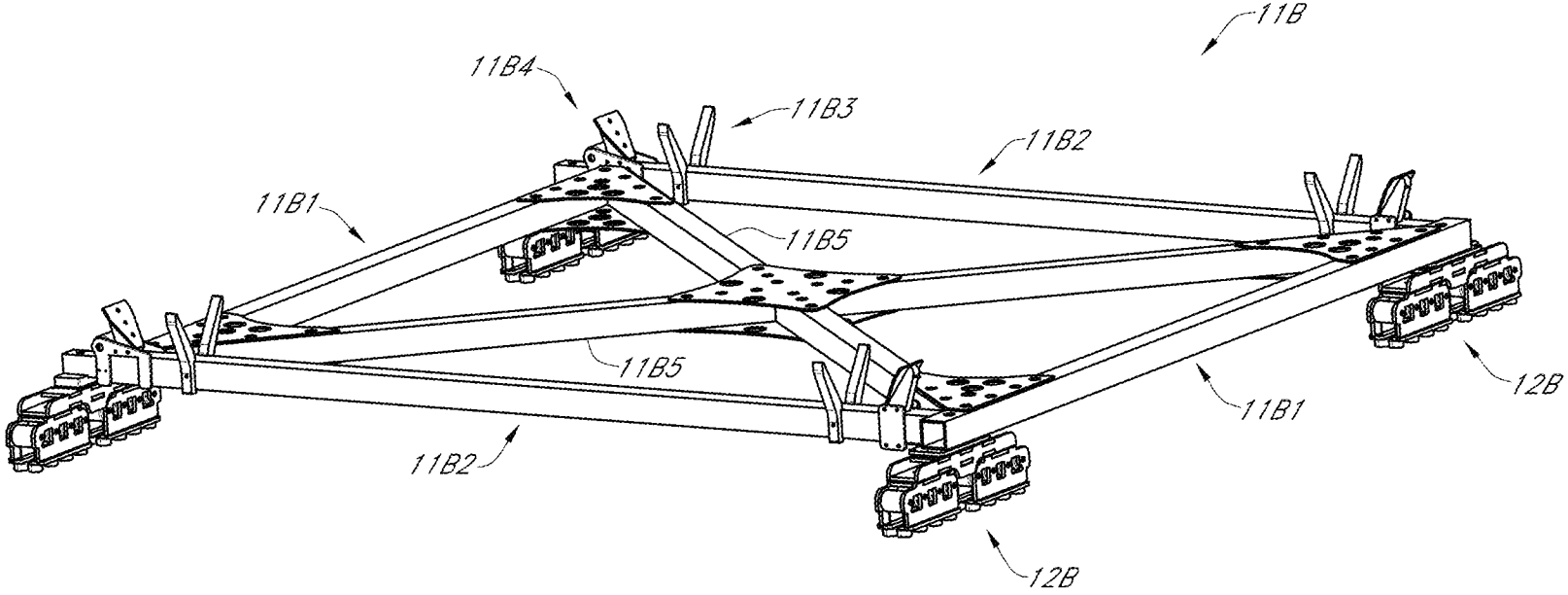
FIG. 11 is a perspective view of a lower frame of the trolley assembly of FIG. 10.
Figure 12:
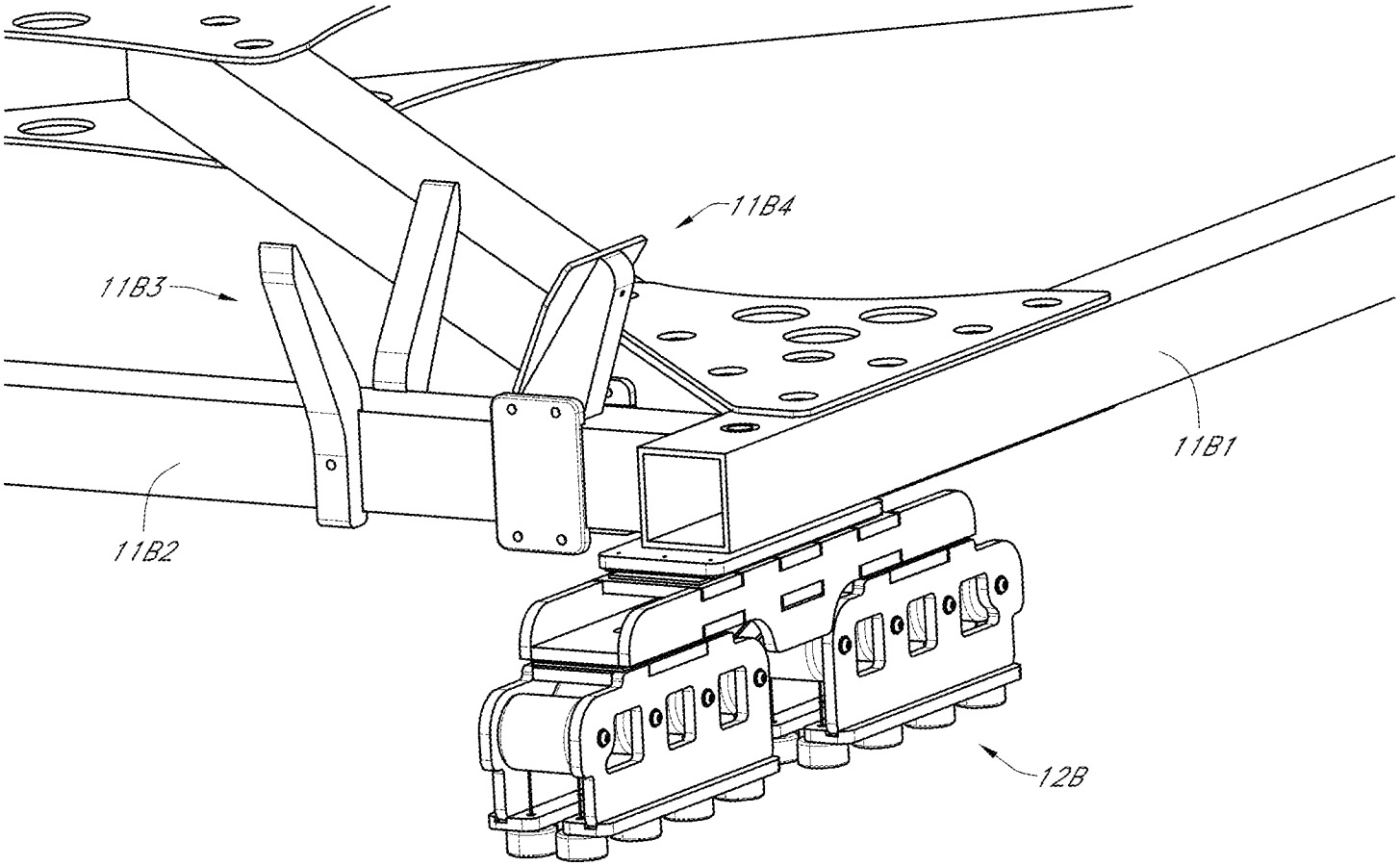
FIG. 12 is a partial view of the lower frame of FIG. 11.

FIG. 9 shows one embodiment of a trolley 10 for use with the assembly 100, 200. The trolley 10 can be made of metal, such as aluminium or steel. In one embodiment, the trolley 10 can be rated to hold a boat B weighing 26000 lbs or more. The trolley 10 can have a pair of side rails 11, each of which is coupled to a plurality of wheels 12 (e.g., Delrin wheels) that can ride on the track 20. In the illustrated embodiment, each side rail 11 is coupled to or supports three sets of wheels 12. The trolley 10 can include a frame 14 that extends between the pair of rails 11 and defines a channel 18 along a longitudinal axis of the trolley 10. The trolley 10 also has a plurality of support pads 16 for supporting the hull of the boat B. In the illustrated embodiment, a plurality of support pads 16 are arranged in two rows on each side of the channel 18. The support pads 16 can advantageously be adjustable (e.g., in height, in angular orientation) to allow them to be adjusted to fit varying hull profiles. In the illustrated embodiment, the trolley 10 has six support pads 16 arranged in three pairs about the channel 18. The trolley 10 also defines a channel 19 between each two pairs of support pads 16 in a direction transverse to the longitudinal axis of the trolley 10. Said channel 19 allows for the slings 34 to easily be passed under the hull portion between said two pairs of support pads 16 to couple the slings 34 to the posts 32 when the boat B is to be lowered into the dock channel D, or to decouple the slings 34 from the posts 32 when the boat B has been lifted out of the water and onto the trolley 10 and is ready to be moved to the boat garage G.

FIGS. 10-16 show another embodiment of a boat trolley assembly 10B. The boat trolley assembly 10B is similar to the boat trolley assembly 10 shown in FIGS. 1-9, except as noted below. Thus, the reference numerals used to designate the various components of the boat trolley assembly 10B are similar to those used for identifying the corresponding components of the boat trolley assembly 10 in FIGS. 1-9 and the description for the various components of the boat trolley assembly 10 shown in FIGS. 1-9 is understood to apply to the corresponding components of the boat trolley assembly 10B in FIGS. 10-16, except as described below.

Figure 14:
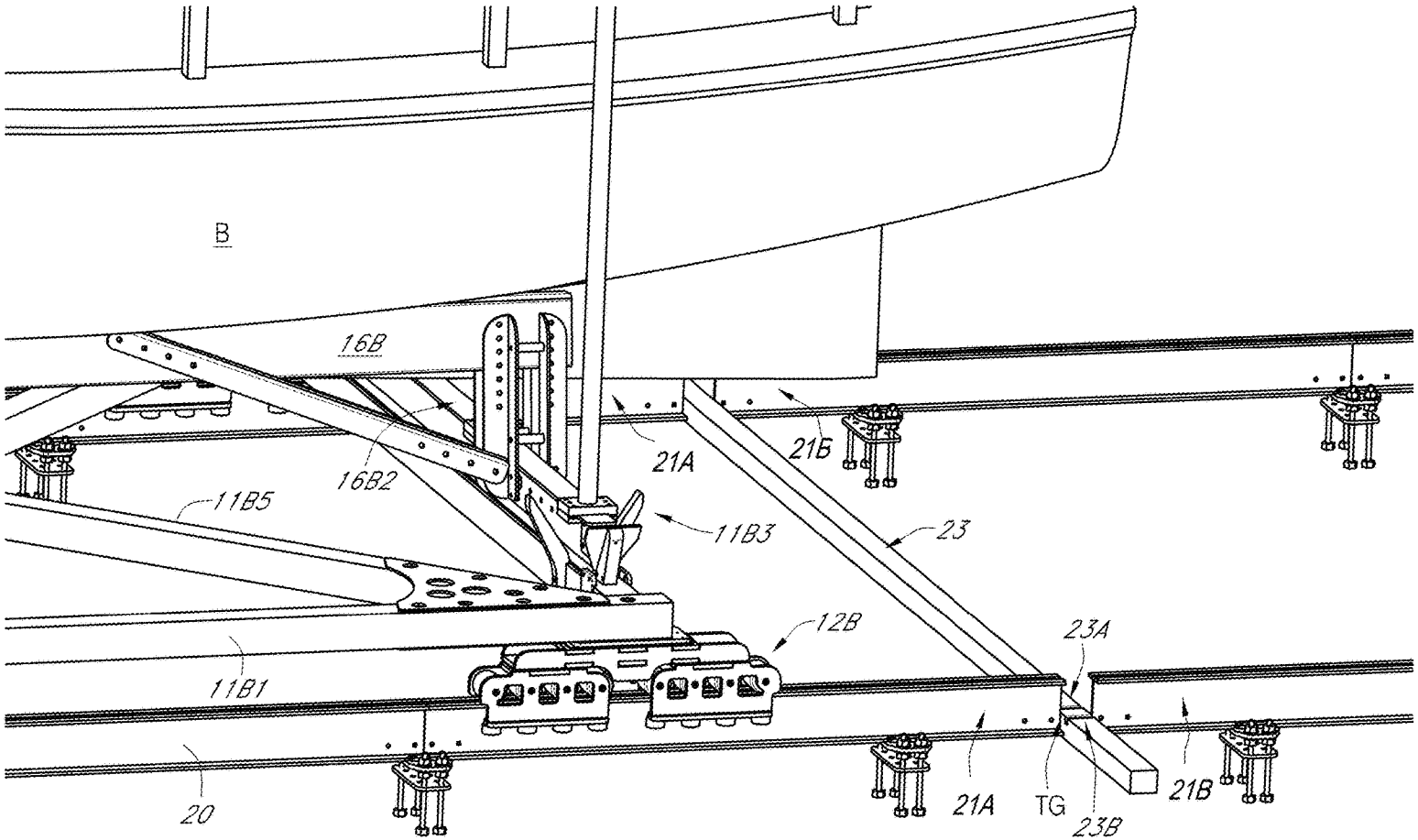
FIG. 14 is a partial view of the trolley assembly of FIGURE. 10 on a track with the boat disposed on the trolley.
Figure 15:
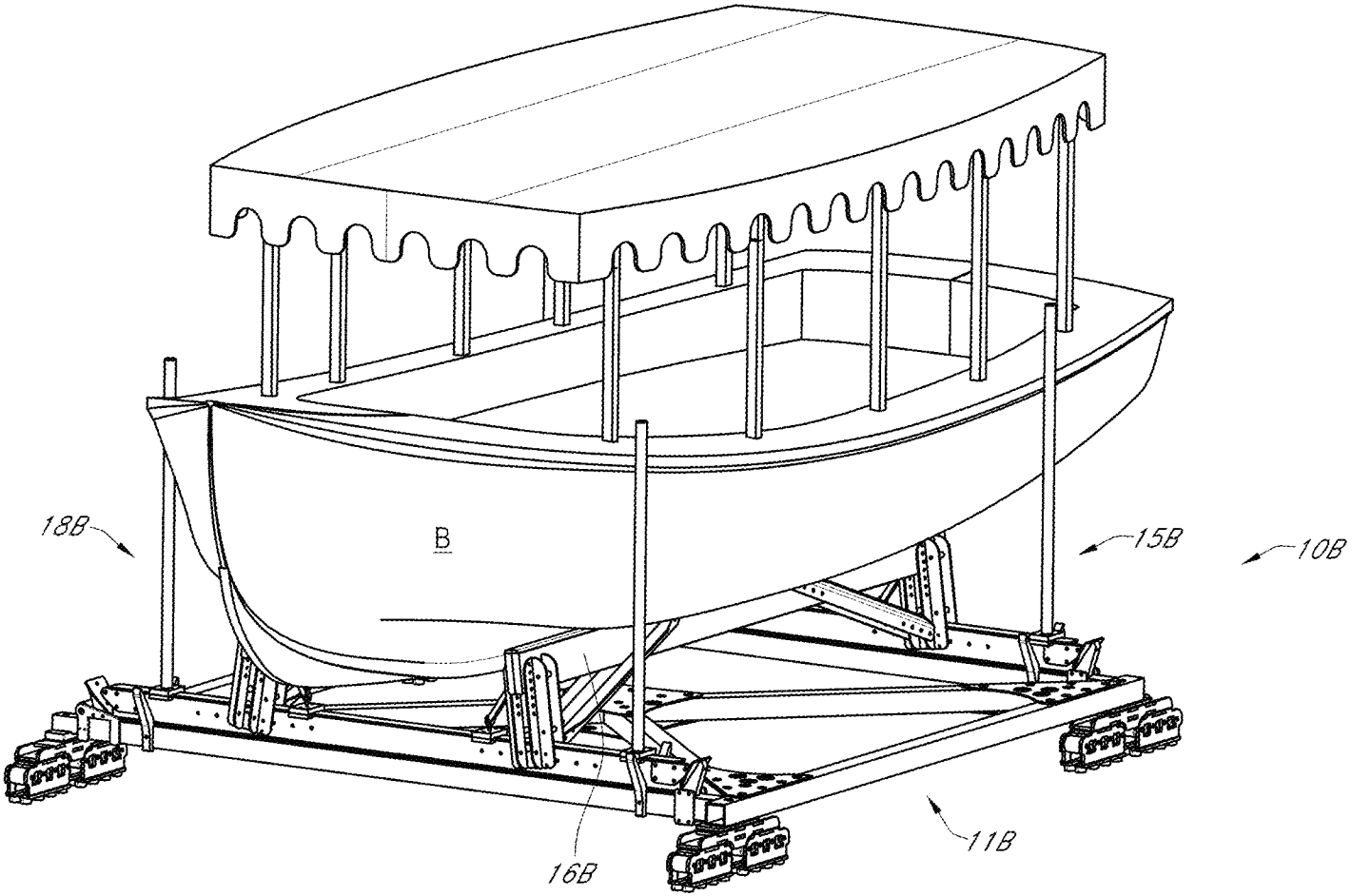
FIG. 15 is a perspective view of the trolley assembly of FIG. 10 with a boat disposed thereon.

The boat trolley assembly 10B includes a lower frame 11B and an upper frame 15B removably disposed on and coupled to the lower frame 11B. The lower frame 11B is supported on a set of wheel assemblies 12B (e.g., Delrin wheels) that couple to rails of the track 20. As best shown in FIG. 14, the wheel assemblies 12B can extend over an I-beam portion of the rails of the track 20 to couple to the track 20.

The lower frame 11B can have support beams 11B1, 11B2 that extend between and couple (e.g., with bolts, welds, etc.) to the set of wheel assemblies 12B. Additionally, the lower frame 11B can have cross-beams 11B5 that extend between the wheel assemblies 12B in a diagonal manner and can couple to the support beams 11B1, 11B2 (e.g., with bolts, welds, etc.).

The lower frame 11B can also have a set of angled delrin guides 11B3 coupled to the beams 11B2 (e.g., with bolts, welds, etc.) that can receive thereon a beam of the upper frame 15B to couple the upper frame 15B to the lower frame 11B. In the illustrated embodiment, the lower frame 11B has four delrin guides 11B3, one at each corner of the lower frame 11B (e.g., proximate the wheel assemblies 12B). However, in other embodiments, the lower frame 11B can have fewer or more delrin guides 11B3. The angled delrin guides 11B3 advantageously allow the upper frame 15B to be positioned properly onto the lower frame 11B, the angled shape of the delrin guides 11B3 allowing the upper frame 15B to achieve the correct position on the lower frame 11B even if the upper frame 15B is initially misaligned relative to the lower frame 11B.

The lower frame 11B also have a plurality of supports (e.g., angled supports) 11B4 (generally at the corners of the lower frame 11B, coupled such as with bolts or welds to the beams 11B2) configured to receive pick points of the upper frame 15B thereon, as discussed further below.

Figure 13:
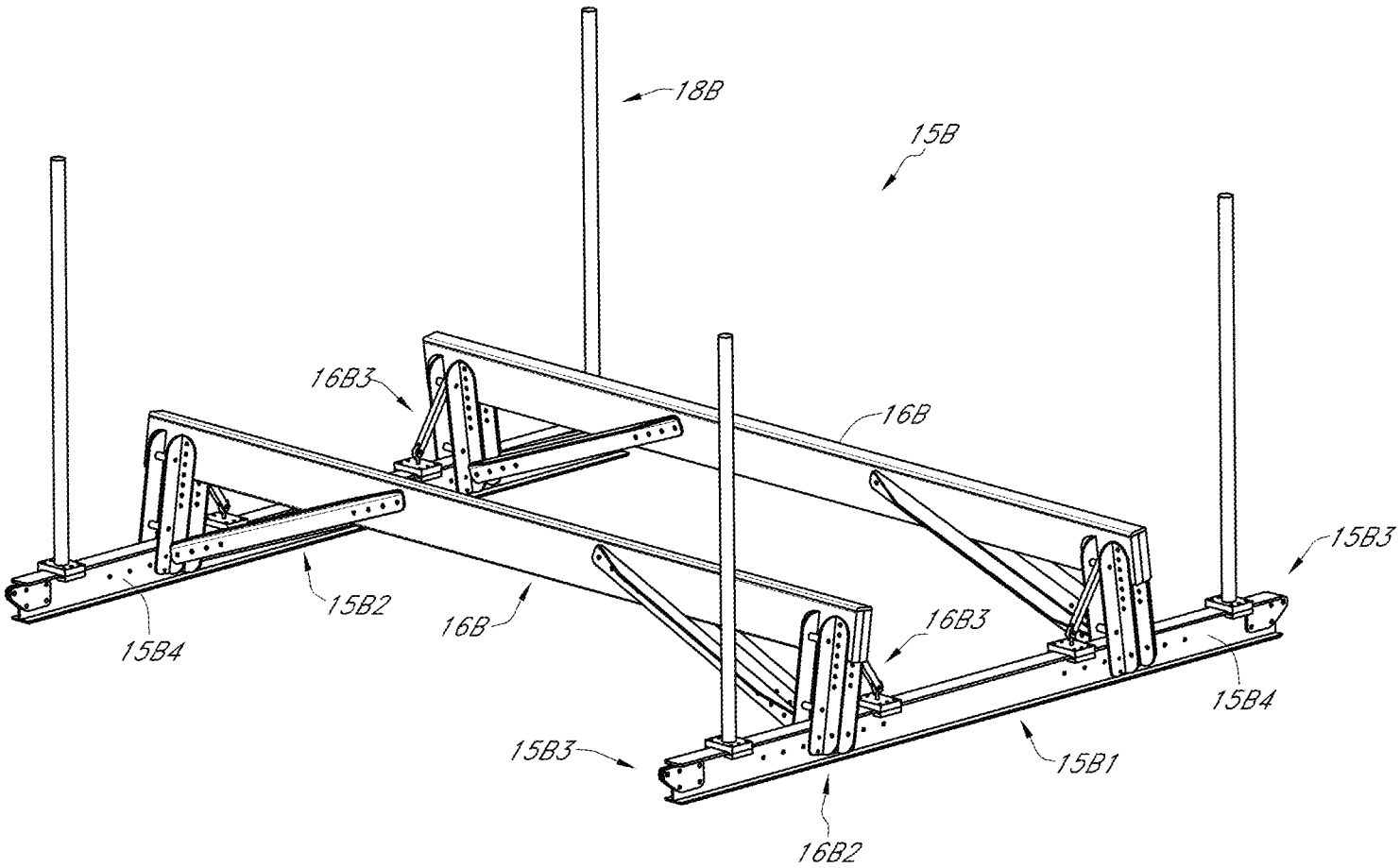
FIG. 13 is a perspective view of an upper frame of the trolley assembly of FIG. 10.

With reference to FIG. 13, the upper frame 15B can include a pair of boat support bunkers 16B that extend between and are coupled (e.g., with bolts) to a pair of support beams 15B1, 15B2 (e.g., I-beams) by bracket assemblies 16B2 on either end of the boat support bunkers 16B. The bracket assemblies 16B2 can couple to the support beams 15B1, 15B2 (e.g., with bolts) at various locations along the length of the support beams 15B1, 15B2 via one or more bolt holes 15B4 in the support beams 15B1, 15B2 (that receive bolts, clevis pins, etc.) to adjust a width between the boat support bunkers 16B to advantageously accommodate a variety of boat hull sizes thereon. Additionally, angle adjustment assemblies 16B3 can couple to the support beams 15B1, 15B2 (e.g., with bolts) and to the bracket assemblies 16B2 proximate the boat support bunkers 16B at both ends of the boat support bunkers 16B. The angle adjustment assemblies 16B3 can be adjusted to adjust the angle between a plane defined by the boat support bunker 16B relative to a horizontal plane defined by the support beams 15B1, 15B2, to advantageously accommodate boat hulls of different sizes and shapes (e.g., boat hulls that are wider and extend at a lower angle towards the bottom of the boat, boat hulls that are narrower and extend at a steeper angle toward the bottom of the boat). Accordingly, the user can adjust (e.g., manually adjust) both the width between the support bunkers 16B and the angle of the support bunkers 16B and the horizontal plane defined by the support beams 15B1, 15B2, as described above, to ensure the support bunkers 16B are adequately spaced and oriented to support the hull of the user's boat B.

The upper frame 15B can have a plurality of pick-up assemblies 15B3 coupled to (e.g., bolted, welded, etc.) to ends of the support beams 15B1, 15B2, from which the upper frame 15B can be raised off of the lower frame 11B, for example to then lower the upper frame 15B with the boat B supported thereon into the water at the end of the dock. In one embodiment, the pick-up assemblies 15B3 can include a quick disconnect member or a clevis pin that can be used to couple cable devises from a lift mechanism to the upper frame 15B (e.g., via holes in pick-up assemblies 15B3) at the dock to lift the upper frame 15B off the lower frame 11B, after which the lower frame 11B can be moved out of the way (as discussed above) to allow the upper frame 15B to be lowered into the water with the boat B thereon so that the boat B can then be navigated in the water.

The upper frame 15B can also have a plurality of vertical guide poles 18B that can serve to guide the operator of the boat B to navigate the boat B onto the upper frame 15B (e.g., in proper alignment) while it's submerged and so that when the upper frame 15B is raised by the lift mechanism, the boat support bunkers 16B can engage and support the bottom of the hull of the boat B.

The lower frame 11B can have one or more proximity sensors that can signal whether the upper frame 15B is disposed more than a predetermined distance above the lower frame 11B, to thereby allow a controller to move the lower frame 11B out of the way before the upper frame 15B is lowered into the water at the dock (via the lift mechanism). In one embodiment, the proximity sensors can be disposed on the delrin guides 11B3. In another embodiment, the proximity sensors can be disposed on one or more of the support beams 11B1, 11B2 or cross-beams 11B5.

Additionally, the posts or pilings 32 of the dock can have one or more sensor clips mounted thereon that can prevent the trolley 10B from moving (e.g., that can communicate a signal to a controller to prevent the trolley 10B from moving) unless the sensor clips are coupled to lift cable devises (e.g., that have been decoupled from the pickup assemblies 15B3 of the upper frame 15B), which would also deactivate the boat lift mechanism. Advantageously, this would prevent the trolley 10B from moving away from the dock while the cables of the lift mechanism were attached to the upper frame 15B, avoiding damage to the dock or lift mechanism. In other embodiments, one or more sensors (e.g., weight sensors on the trolley 10B or sensors on the lift mechanism LM) can sense when the upper frame 15B has been lifted off the lower frame 11B by a predetermined amount to allow the lower frame 11B to be moved out of the dock D to allow the upper frame 15B and boat B to be lowered into the water through the dock channel.

Figure 16:
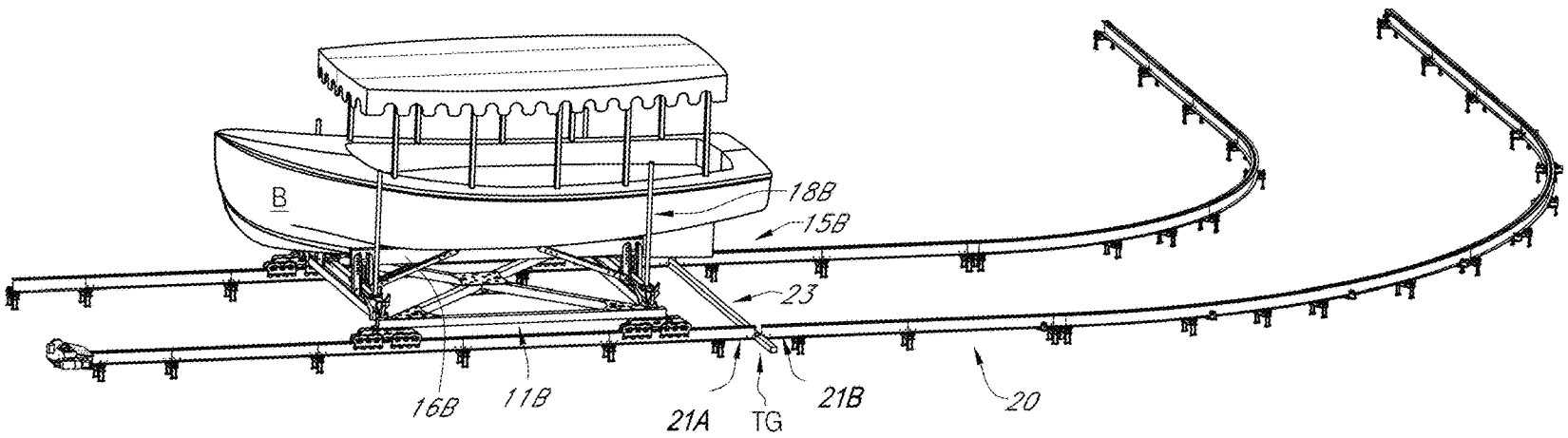
FIG. 16 is a perspective view of the trolley assembly of FIG. 10 on a track and with a boat disposed on the trolley.

With reference to FIGS. 14 and 16, the track 20 can have a gap TG between a first section 21A and a second section 21B_of the track 20 and a spacer member 23 that extends along the gap TG between the first and second sections 21A, 21B. In one embodiment, the gap TG can be defined at the location where the garage door GD closes off the boat garage G to allow the garage door GD to close the garage G (e.g., for the garage door GD to bear against the spacer member 23) so as to inhibit entry of debris (e.g., leaves, dirt) and vermin or insects into the garage G. The wheel assemblies 12, 12B advantageously can span the gap TG so that the gap TG does not inhibit the movement of the trolley 10, 10B over the gap TG while it moves from the first section 21A to the second section 21B of the track 20. The spacer member 23 has a first groove 23A on one side of the track 20 and a second groove 23B on an opposite side of the track 20, where the grooves 23A, 23B can receive a chain drive (not shown) of the drive mechanism when the chain detensions (e.g., once the trolley 10, 10B is in the boat garage G and has stopped moving).

The trolley assembly 10B can be made of a suitable metal (e.g., rust resistant metal, such as aluminium or stainless steel). In one embodiment, the boat support bunkers 16B can be made out of wood. However, other suitable materials can be used. In one embodiment, the trolley assembly 10B can have a weight rating of 10,000 pounds. However, in other embodiments, the trolley assembly 10B can support boats B weighing less than or more than this.

Figure 17:
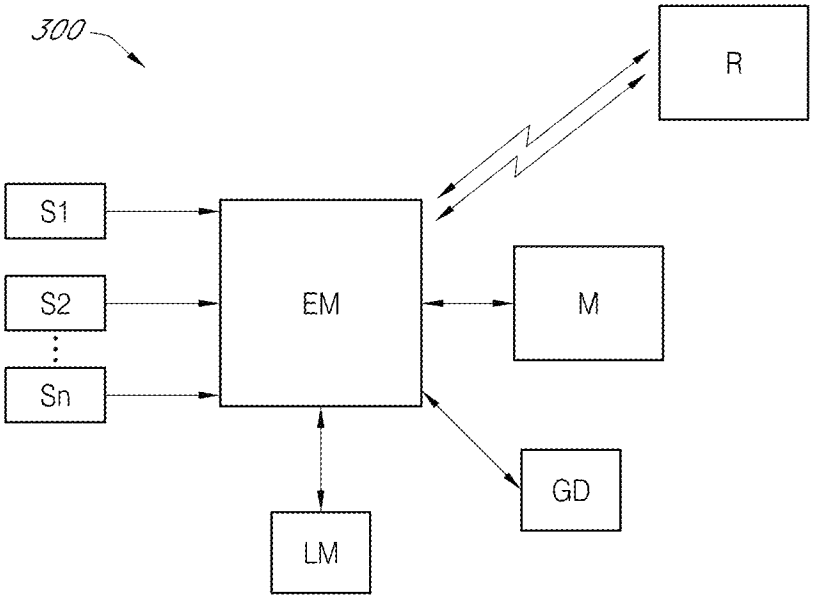
FIG. 17 is a schematic block diagram showing a control module for the boat lift and trolley assembly.

FIG. 17 shows a block diagram of a control system 300 for the boat lift and trolley assembly 100, 200. The control system 300 includes a controller EM that receives information from a plurality of sensors S1-Sn. The controller EM sends control signals to the motor M and receives operational information from the motor M based at least in part on the information from the plurality of sensors S1-Sn. One or more of the sensors S1 can be on the trolley 10 to sense a position and/or motion of the trolley. One or more of the sensors S2 can be located in one or more locations on the track 20 to sense a position of the trolley 10. For example, at least one of the sensors S2 can be located in the boat garage G, just outside the boat garage G, and/or at the edge of the dock channel D. One or more sensors S3 can be located on the garage door of the boat garage G. One or more sensors S4 can be located on the posts 32 to sense when the slings 34 are connected thereto.

In operation, the boat B can be disposed within the boat garage G and on top of the trolley 10B frame with the garage door GD in a closed position. A user can initiate the automated deployment of the boat B by actuating a button, such as a "trolley out" activation button or "garage door open" activation button on a controller (e.g., control attached to the garage G, handheld remote control R, or a mobile electronic device such as a smartphone), at which point the garage door GD can open. Once the garage door GD is open (e.g., and triggers a signal from a "garage open" sensor S3, such as a proximity sensor that senses a location of the garage door GD), the controller EM can turn on a chain tensioner to tension a drive chain attached to the trolley 10B). When the drive chain is tensioned to a predetermined amount, as sensed by a (tension) sensor S4, the controller EM can receive a signal that movement of the trolley 10B is allowed. The operator can optionally press and hold a "trolley out" button to actuate the motor M to move the trolley 10B (and the boat B) out of the boat garage G. The "trolley out" button can optionally be a deadman button that the operator must continuously press for the trolley 10B to move. As the trolley 10B moves, one or more sensors S1 (e.g., proximity sensors) on the trolley 10B can sense for obstructions in the trolley's path (e.g., on the track 20), and can signal the controller EM to stop movement of the trolley 10B if an obstruction is sensed. In one embodiment, the lift mechanism can have one or more sensors S5 that can communicate with the controller EM; for example, the lift mechanism can have one or more sensors S5 indicating that the lift cables/slings are in a stowed position and can communicate such a signal to the controller EM. The controller EM can operate the motor M to move the trolley 10B based at least in part on said signals from the lift mechanism, and the controller EM can stop movement of the trolley 10B if it does not receive such a stowed signal from the lift mechanism.

If the trolley 10B is stopped in the garage door GD area, one or more track sensors S2 (e.g., sensors proximate the gap TG) can communicate with the controller EM to inhibit the closing of the garage door GD until the trolley 10B is clear of the garage door GD area. The trolley 10B can continue to travel toward the dock D (e.g., via a chain drive actuated by the motor M under the control of the controller EM). One or more track end sensors S2 can communicate with the controller EM to stop the position of the trolley 10B in a predetermined position on the dock D once it is reached. As discussed above, clips from the lift mechanism can then be attached to pick-up mechanisms 15B3 (e.g., lift devises) of the upper frame 15B of the trolley 10B. The movement of the lift cable or sling from the stowed position can lock the movement of the trolley 10B, as discussed above. The operator can then press a "lift up" button to raise the boat B (and upper frame 15B) off the lower frame 11B of the trolley 10B. In one embodiment, the lift mechanism will not operate to lift the boat B unless all dock side cable clip sensors S5 are vacant (indicating that the lift cable clips have been moved from the stowed position to couple them to the upper frame 15B.

The "lift up" button actuation can lift the upper frame 15B and boat B off the lower frame 11B of the trolley 10B until a lift stop sensor S6 senses that the upper frame 15B has been lifted by at least a predetermined amount. Once said predetermined amount is reached, the lift stop sensor S6 can communicate a signal to the controller EM, allowing the controller EM to allow movement of the lower frame 11B of the trolley 10B.

Optionally, the operator can then press a "trolley in" button to cause the controller EM to move the lower frame 11B of the trolley 10B from underneath the upper frame 15B (e.g., via the motor M operated chain drive attached to the lower frame 11B). The trolley 10B can be moved until a parking sensor S7 is activated, indicating that the lower frame 11B of the trolley 10B is clear of the boat B, at which point the controller EM can receive a signal to stop movement of the lower frame 11B. At this point, the operator can actuate the lift mechanism to lower the boat and upper frame 15B into the water. Advantageously, the parking sensor S7 would prevent the lift mechanism from lowering the upper frame 15B and boat B if it does not sense that the lower frame 11B is clear of the upper frame 15B.

Once use of the boat B was complete, the operator could navigate the boat B back onto the upper frame 15B while this is submerged in the water and press a "lift up" button to lift the boat B and upper frame 15B out of the water. Once a sensor S6 of the lift mechanism indicates the boat B is in the lifted position, such a sensor can communicate a signal to the controller EM allowing movement of the lower frame 11B. The operator can press a "trolley out" button to operate the motor M to drive the lower frame 11B under the upper frame 15B until a track end sensor is triggered. The operator can then operate the lift mechanism to lower the upper frame 15B onto the lower frame 11B, as discussed above, at which point the operator can decouple the lift cable clips from the upper frame 15B and place them in the stowed position, thereby triggering the cable/sling stowed signal that can communicate to the controller EM that the trolley 10B can be moved. Such a signal allowing the trolley 10B to move, will not occur unless all the cable clip sensors S5 on the lift mechanism indicate that the lift cables have been stowed and are no longer attached to the upper frame 15B. The operator can then operate a "trolley in" button to cause the controller EM to move the trolley 10B (via the motor M driven chain drive) toward the garage G. The signal from the cable clip sensors S5 indicating that the lift cables are stowed, would allow the trolley 10B to continue moving toward the garage G without stopping once it passes the parking sensor S7, as discussed above. Optionally, a release and reapplication of the "trolley in" button can bypass the stop point indicated by the parking sensor S7.

The controller EM could continue to move the trolley 10B toward the garage G (e.g., as long as the operator continues to press the "trolley in" button). The trolley 10B will thus continue to move until it triggers and "end of track" sensors S8, which signal communicated to the controller EM will stop movement of the trolley 10B. Additionally, the controller EM can prevent the closure of the garage door GD if an inside track sensor S9 (e.g., track sensor located inside the garage G) senses that the trolley 10B is too close to the garage door GD). Once properly inside the garage G, the operator can press the "door close" button, causing the controller EM to activate the chain de-tensioner, which allows the chain to lose tension and rest in the grooves 23A, 23B discussed above, allowing the garage door GD to fully close. A garage door sensor S10 can be used to sense if there are obstacles in the closing plane of the garage door GD and if so can communicate a stop signal to the motor activating the movement of the garage door GD.

As discussed above, the actuation buttons for the various actions of the system (e.g., trolley in, trolley out, etc.) can be on a remote control R (e.g., a handheld remote control); in another embodiment, the user and use a mobile electronic device, such as a mobile phone or tablet (e.g., which has been paired with the controller EM and communicates wirelessly with the controller EM, such as via Bluetooth, Wi-Fi, RF), as the remote control R to actuate the controller EM (e.g., via a mobile app previously installed on the mobile electronic device, or via the internet without using a mobile app).

With reference to FIG. 17, operation of the trolley 10 embodiment is very similar to that of the trolley 10B, discussed above. The one or more sensors S1 on the trolley 10 and/or one or more sensors S2 on the track 20 can sense once the trolley 10 is clear of the boat garage G (e.g., more than a predetermined distance away from the entrance of the boat garage G) and the controller EM can actuate the garage door GD to close, and the one or more sensors S3 can sense the position of the garage door GD. If said sensors S1, S2 sense that the trolley 10 is not clear of the boat garage G, the controller EM can inhibit (e.g., prevent) the garage door GD from closing to prevent the garage door from striking the boat B.

Once clear of the boat garage G, the controller EM can operate the motor M (e.g., via a deadman button pressed by the operator) to move the trolley 10 toward the dock channel D. One or more of the sensors S1, S2 can sense when the trolley 10 is adjacent the opening of the dock channel D. At this point, the user can decouple the slings 34 from the posts 32, and the sensors S5 can communicate said decoupling to the controller EM, which can then actuate the motor M to move the trolley 10 over the opening in the dock channel D. The user can then position the slings 34 under the boat B and recouple the ends of the slings 34 to the posts 32. The sensors S5 can communicate the recoupling of the slings 34 to the posts 32, and the controller EM can operate the lift mechanism LM to lift the boat B off the trolley 10 frame 14. Once the boat B is off the trolley 10 (e.g., as sensed by one or more sensors, such as weight sensors on the trolley 10 or sensors S6 on the lift mechanism LM), the controller EM can move the trolley 10 from below the boat B and out of the opening in the dock channel D, and can then operate the lift mechanism LM to lower the boat into the dock channel D and onto the water surface. The user can then operate the boat B.

Once done operating the boat B, the boat B can be moved from the dock channel D to back to the boat garage G by operating the control system 300 and boat lift and trolley assembly 100, 200 in the reverse order. First the user can move the boat B back into position in the dock channel and confirm the slings 34 are disposed under the hull of the boat B. The controller EM can operate the lift mechanism LM to lift the boat B out of the dock channel D. One or more sensors S6 can sense when the boat B has been lifted to a predetermined position out of the dock channel D; for example, sensors S6 can sense a position of the boat B and/or the slings 34 to sense that the predetermined position has been reached and communicate this to the controller EM. The controller EM can operate the motor M to move the trolley 10 into position under the boat B, and one or more sensors S1, S2 can inform the controller EM when the trolley 10 is under the boat B, at which point the controller EM can operate the lift mechanism LM to lower the boat B onto the trolley 10 frame. If the trolley 10 frame is not completely under the boat B, as sensed by one or more of the sensors S1, S2, the controller EM can prevent the lift mechanism LM from lowering the boat B. One or more sensors (e.g., weight sensors) can sense when the boat B has been placed on the trolley 10 frame, and a user can decouple the slings 34 from the posts 32 and remove the slings from under the boat B, at which point the controller EM can operate the motor M to move the trolley 10 away from the dock channel D and toward the boat garage G. The user can the recouple the slings 34 to the posts 32.

One or more sensors S1, S2 can sense when the trolley 10 is proximate the garage G, and the controller EM can operate the garage door GD to open. Sensors S10 on the garage door GD can indicate the position of the garage door GD, and the controller EM can operate the motor M to move the trolley 10 into the garage G based on an indication that the garage door GD is fully open. One or more sensors S2 can inform the controller EM when the trolley 10 frame 14, with the boat B thereon, is fully inside the boat garage G, and the controller EM can operate the garage door GD to close.

In addition to the indications provided to the controller EM by the one or more sensors S2 on the track 20 or on the trolley 10, as discussed above, the sensors S2 can inform the controller EM if there are any obstructions on the track 20, and the controller EM can prevent movement of the trolley 10 based on said sensed information until such an obstruction is no longer sensed.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An automated trolley system for moving a boat from a boat garage and a dock, comprising:

a boat trolley configured to support a boat thereon, the boat trolley having a set of wheels configured to movably couple the trolley to a pair of rails of a track, the boat trolley comprising a lower frame coupled to the set of wheels such that a wheel assembly of the set of wheels is coupled proximal each corner of the lower frame, the lower frame comprising one or more guides on an upper surface of the lower frame and extending upwardly therefrom, and an upper frame removably coupleable to the lower frame, the upper frame comprising a pair of bunkers disposed over and operatively coupled to the upper frame, the pair of bunkers configured to support the boat on the upper frame, the upper frame having one or more beams that at least partially define a bottom portion of the upper frame, the one or more beams configured to be received in the one or more guides of the lower frame to thereby couple the upper frame to the lower frame by lowering the one or more beams into the one or more guides, the upper frame configured to be completely decoupled from the lower frame by lifting the one or more beams from the one or more guides.

2. The system of claim 1, wherein a width between the pair of bunkers is adjustable to support boat hulls of varying sizes.

3. The system of claim 2, wherein an angular orientation of each of the bunkers relative to the lower frame is adjustable to support boat hulls of different shapes.

4. The system of claim 3, further comprising adjustable brackets coupled to the pair of bunkers, wherein one or both of a position and orientation of the adjustable brackets are adjustable to adjust the width between the pair of support bunkers and the angular orientation of the pair of bunkers to accommodate boats of different sizes and shapes.

5. The system of claim 1, wherein the one or more guides taper outward to facilitate coupling of the upper frame to the lower frame, the outward taper configured to guide the one or more beams of the upper frame into alignment with the one or more guides during coupling of the upper frame to the lower frame.

6. The system of claim 1, further comprising one or more sensors configured to sense a position of at least a portion of the boat trolley.

7. The system of claim 6, wherein the one or more sensors comprises a proximity sensor configured to sense a vertical distance between the upper frame and the lower frame.

8. The system of claim 6, further comprising a controller configured to control operation of the boat trolley to move the boat trolley along the track based at least in part on sensed information communicated by the one or more sensors to the controller.

9. The system of claim 8, wherein the controller is configured to communicate with a remote control device to operate one or both of a motion of the boat trolley and a garage door of the boat garage.

10. The system of claim 9, wherein the remote control device is a mobile electronic device.

11. An automated trolley system for moving a boat from a boat garage and a dock, comprising:

a boat trolley configured to support a boat thereon, the boat trolley having a set of wheels configured to movably couple the trolley to a pair of rails of a track, the boat trolley comprising a lower frame coupled to the set of wheels, the lower frame comprising one or more guides on an upper surface of the lower frame and extending upwardly therefrom, and an upper frame removably coupleable to the lower frame, the upper frame comprising a pair of bunkers disposed over and operatively coupled to the upper frame, the pair of bunkers configured to support the boat on the upper frame, the upper frame having one or more beams that at least partially define a bottom portion of the upper frame, the one or more beams configured to be received in the one or more guides of the lower frame to couple the upper frame to the lower frame by lowering the one or more beams into the one or more guides, the upper frame configured to be completely decoupled from the lower frame by lifting the one or more beams from the one or more guides.

12. The system of claim 11, wherein a width between the pair of bunkers is adjustable to support boat hulls of varying sizes.

13. The system of claim 11, wherein an angular orientation of each of the bunkers relative to the lower frame is adjustable to support boat hulls of different shapes.

14. The system of claim 13, further comprising adjustable brackets coupled to the pair of bunkers, wherein one or both of a position and orientation of the adjustable brackets are adjustable to adjust a width between the pair of bunkers to accommodate boats of different sizes and shapes.

15. The system of claim 11, wherein the one or more guides taper outward to facilitate coupling of the upper frame to the lower frame, the outward taper configured to guide the one or more beams of the upper frame into alignment with the one or more guides during coupling of the upper frame to the lower frame.

16. The system of claim 11, further comprising one or more sensors configured to sense position of at least a portion of the boat trolley.

17. The system of claim 16, wherein the one or more sensors comprises a proximity sensor configured to sense a vertical distance between the upper frame and the lower frame.

18. The system of claim 16, further comprising a controller configured to control operation of the boat trolley to move the boat trolley along the track based at least in part on sensed information communicated by the one or more sensors to the controller.

19. The system of claim 18, wherein the controller is configured to communicate with a remote control device to operate one or both of a motion of the boat trolley and a garage door of the boat garage.

20. The system of claim 19, wherein the remote control device is a mobile electronic device.

* * * * *